US011697286B2

(12) United States Patent
Arakane et al.

(10) Patent No.: US 11,697,286 B2
(45) Date of Patent: Jul. 11, 2023

(54) LIQUID DISCHARGING APPARATUS, METHOD FOR CONTROLLING THE LIQUID DISCHARGING APPARATUS, AND COMPUTER-READABLE STORAGE MEDIUM

(71) Applicant: BROTHER KOGYO KABUSHIKI KAISHA, Nagoya (JP)

(72) Inventors: Satoru Arakane, Nagoya (JP); Yasuhiro Nakano, Nagoya (JP); Shin Hasegawa, Nagoya (JP); Shotaro Iida, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/591,807

(22) Filed: Feb. 3, 2022

(65) Prior Publication Data

US 2022/0250384 A1 Aug. 11, 2022

(30) Foreign Application Priority Data

Feb. 8, 2021 (JP) ..... 2021-017898

(51) Int. Cl.
*B41J 2/165* (2006.01)

(52) U.S. Cl.
CPC ..... *B41J 2/16526* (2013.01); *B41J 2/1652* (2013.01); *B41J 2002/16573* (2013.01)

(58) Field of Classification Search
CPC ..... B41J 2/16526; B41J 2/1652
See application file for complete search history.

(56) References Cited

U.S. PATENT DOCUMENTS

2014/0176642 A1* 6/2014 Kobayashi ..... B41J 19/202 347/35

FOREIGN PATENT DOCUMENTS

JP 3587111 B2 * 11/2004 ..... B41J 2/16508
JP 2005-343010 A 12/2005
JP 2018-199255 A 12/2018

* cited by examiner

*Primary Examiner* — Sharon Polk
(74) *Attorney, Agent, or Firm* — Merchant & Gould P.C.

(57) ABSTRACT

A liquid discharging apparatus, having a head with nozzles, a scanning assembly, a conveyer, and a controller, is provided. The controller is configured to determine whether the nozzles are to be flushed in a moving action which accompanies a discharging action, if the controller determines the nozzles are not to be flushed in the moving action, conduct the moving action to move the head at a first acceleration rate; if the controller determines the nozzles are to be flushed in the moving action, determine whether a distance between a flushing range and a discharging range is greater than or equal to a predetermined distance; and if the controller determines the distance is greater than or equal to the predetermined distance, conduct the moving action to move the head at a second acceleration rate and control the head to discharge liquid for flushing the nozzles.

9 Claims, 12 Drawing Sheets

LIQUID DISCHARGING APPARATUS, METHOD FOR CONTROLLING THE LIQUID DISCHARGING APPARATUS, AND COMPUTER-READABLE STORAGE MEDIUM

CROSS REFERENCE TO RELATED APPLICATIONS

This application claims priority under 35 U.S.C. § 119 from Japanese Patent Application No. 2021-017898, filed on Feb. 8, 2021, the entire subject matter of which is incorporated herein by reference.

BACKGROUND

The present disclosure is related to a liquid discharging apparatus capable of conducting a flushing process while a head is accelerating, a method for controlling the liquid discharging apparatus, and a computer-readable storage medium storing computer readable instructions for controlling the liquid discharging apparatus.

A head configured to discharge liquid through nozzles at a liquid receiver as the head accelerates, i.e., flushing including pre-print flushing and flushing while printing, is known. The action of flushing may clear thickened liquid in the nozzles and restrain incorrect liquid discharging while printing. Moreover, the flushing action while the head accelerates may shorten time for printing compared to a printing operation, in which the flushing action is conducted while the head pauses.

SUMMARY

However, as the flushing action is conducted while the head is accelerating, negative pressure may be produced in the head due to dynamic pressure. Therefore, an amount of the liquid to be discharged for flushing may become insufficient, and thickening of the liquid may not be cleared effectively.

The present disclosure is advantageous in that a liquid discharging apparatus capable of conducting a flushing process while a head is accelerating, in which negative pressure in the head may be restrained, and which may discharge a sufficient amount of liquid, is provided, and, moreover, a method for controlling the liquid discharging apparatus and a computer readable storage medium storing computer readable instructions for controlling the liquid discharging apparatus are provided.

According to an aspect of the present disclosure, a liquid discharging apparatus, including a head having a plurality of nozzles, a scanning assembly configured to move the head in a scanning direction, a conveyer configured to covey a recording medium with respect to the head in a conveying direction, the conveying direction intersecting with the scanning direction, and a controller, is provided. The controller is configured to, for recording an image on the recording medium, conduct actions to control the head to discharge liquid through the plurality of nozzles at the recording medium based on image data. The actions include a conveying action, in which the controller controls the conveyer to convey the recording medium by a predetermined amount in the conveying direction, a moving action, in which the controller controls the scanning assembly to move the head in the scanning direction, and a discharging action, in which the controller controls the head to discharge the liquid through the plurality of nozzles while the head is moved by the scanning assembly in the moving action. The controller is further configured to, for flushing the plurality of nozzles with the liquid, control the head to discharge the liquid through the plurality of nozzles at a flushing range based on flushing data, the flushing data being different from the image data, while the head being moved in the moving action is accelerating. The controller is further configured to determine whether the plurality of nozzles are to be flushed in the moving action which accompanies the discharging action, in a case where the controller determines that the plurality of nozzles are not to be flushed in the moving action, conduct the moving action to move the head at a first acceleration rate, in a case where the controller determines that the plurality of nozzles are to be flushed in the moving action, determine whether a distance between the flushing range and a discharging range, in which the liquid is to be discharged through the plurality of nozzles in the discharging action, is greater than or equal to a predetermined distance, and in a case where the controller determines that the distance is greater than or equal to the predetermined distance, conduct the moving action to move the head at a second acceleration rate being lower than the first acceleration rate and control the head to discharge the liquid for flushing the plurality of nozzles.

According to another aspect of the present disclosure, a method for controlling a liquid discharging apparatus is provided. The liquid discharging apparatus includes a head having a plurality of nozzles, a scanning assembly configured to move the head in a scanning direction, and a conveyer configured to covey a recording medium with respect to the head in a conveying direction, which intersects with the scanning direction. The method includes, for recording an image on the recording medium, conducting actions to control the head to discharge liquid through the plurality of nozzles at the recording medium based on image data. The actions include a conveying action, in which the conveyer is controlled to convey the recording medium by a predetermined amount in the conveying direction, a moving action, in which the scanning assembly is controlled to move the head in the scanning direction, and a discharging action, in which the head is controlled to discharge the liquid through the plurality of nozzles while the head is moved by the scanning assembly in the moving action. The method further includes flushing the plurality of nozzles with the liquid by controlling the head to discharge the liquid through the plurality of nozzles at a flushing range based on flushing data, which is different from the image data, while the head being moved in the moving action is accelerating. For controlling the liquid discharging apparatus, the method further includes determining whether the plurality of nozzles are to be flushed in the moving action which accompanies the discharging action, in a case where the plurality of nozzles are determined not to be flushed in the moving action, conducting the moving action to move the head at a first acceleration rate, in a case where the plurality of nozzles are determined to be flushed in the moving action, determining whether a distance between the flushing range and a discharging range, in which the liquid is to be discharged through the plurality of nozzles in the discharging action, is greater than or equal to a predetermined distance, and in a case where the distance is determined to be greater than or equal to the predetermined distance, conducting the moving action to move the head at a second acceleration rate being lower than the first acceleration rate and controlling the head to discharge the liquid for flushing the plurality of nozzles.

According to another aspect of the present disclosure, a non-transitory computer readable storage medium storing computer readable instructions that are executable by a computer configured to control a liquid discharging apparatus is provided. The liquid discharging apparatus includes a head having a plurality of nozzles, a scanning assembly configured to move the head in a scanning direction, and a conveyer configured to covey a recording medium with respect to the head in a conveying direction, which intersects with the scanning direction. The computer readable instructions, when executed by the computer, cause the computer to, for recording an image on the recording medium, conduct actions to control the head to discharge liquid through the plurality of nozzles at the recording medium based on image data. The actions include a conveying action, in which the computer controls the conveyer to convey the recording medium by a predetermined amount in the conveying direction, a moving action, in which the computer controls the scanning assembly to move the head in the scanning direction, and a discharging action, in which the computer controls the head to discharge the liquid through the plurality of nozzles while the head is moved by the scanning assembly in the moving action. The computer readable instructions, when executed by the computer, further cause the computer to, for flushing the plurality of nozzles with the liquid, control the head to discharge the liquid through the plurality of nozzles at a flushing range based on flushing data, which is different from the image data, while the head being moved in the moving action is accelerating. The computer readable instructions, when executed by the computer, further cause the computer to determine whether the plurality of nozzles are to be flushed in the moving action which accompanies the discharging action, in a case where the computer determines that the plurality of nozzles are not to be flushed in the moving action, conduct the moving action to move the head at a first acceleration rate, in a case where the computer determines that the plurality of nozzles are to be flushed in the moving action, determine whether a distance between the flushing range and a discharging range, in which the liquid is to be discharged through the plurality of nozzles in the discharging action, is greater than or equal to a predetermined distance, and in a case where the computer determines that the distance is greater than or equal to the predetermined distance, conduct the moving action to move the head at a second acceleration rate being lower than the first acceleration rate and control the head to discharge the liquid for flushing the plurality of nozzles.

DETAILED DESCRIPTION

First Embodiment

In the following paragraphs, with reference to the accompanying drawings, embodiments of the present disclosure will be described. It is noted that a printer described below is merely one embodiment of the present disclosure, and various connections may be set forth between elements in the following description. These connections in general and, unless specified otherwise, may be direct or indirect and that this specification is not intended to be limiting in this respect.

First, with reference to FIGS. 1-3, an overall configuration of a printer 100 and detailed configuration of the printer 100 according to a first embodiment of the present disclosure will be described.

Figure 1:
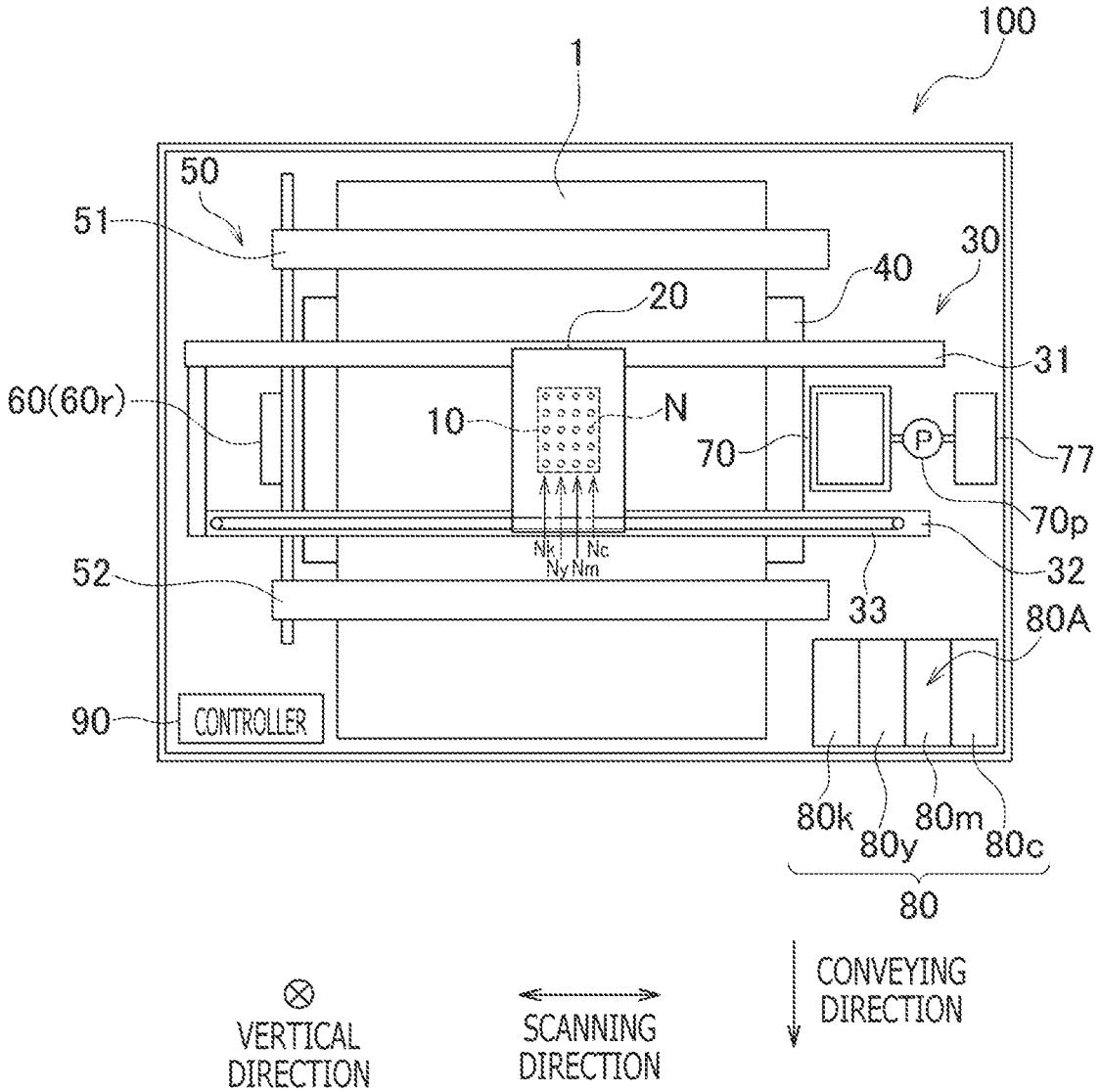
FIG. 1 is a plan view to illustrate an overall configuration of a printer according to a first embodiment of the present disclosure.

As shown in FIG. 1, the printer 100 has a head 10, a carriage 20, a scanning assembly 30, a platen 40, a conveyer 50, a flushing receiver member 60, a cap 70, an attachment section 80A, and a controller 90. The head 10 has a lower surface, on which a plurality of nozzles N are formed. The carriage 20 retains the head 10. The scanning assembly 30 may move the carriage 20 and the head 10 in a scanning direction, which intersects orthogonally with a vertical direction. The platen 40 may support a sheet 1 (recording medium) from a lower side. The conveyer 50 may convey the sheet 1 in a conveying direction, which intersects orthogonally with the scanning direction and the vertical direction. The flushing receiver member 60 is located on one side of the platen 40 in the scanning direction, and the cap 70 is located on the other side of the platen 40 in the scanning direction. To the attachment section 80A, a cartridge unit 80 (tank) is attachable.

The nozzles N form four (4) nozzle arrays Nc, Nm, Ny, Nk, which align side by side in the scanning direction. Each of the nozzle arrays Nc, Nm, Ny, Nk consists of a plurality of nozzles N, which align along the conveying direction. The nozzles N forming the nozzle array Nc may discharge cyan ink, the nozzles N forming the nozzle array Nm may discharge magenta ink, the nozzles N forming the nozzle array Ny may discharge yellow ink, and the nozzles N forming the nozzle array Nk may discharge black ink.

The scanning assembly 30 includes a pair of guides 31, 32, which support the carriage 20 and a belt 33 connected to the carriage 20. The guides 31, 32 and the belt 33 longitudinally extend in the scanning direction. When a carriage motor 30*m* (see FIG. 3) is driven under control of the controller 90, the belt 33 may run, and the carriage 20 and the head 10 may move along the guides 31, 32 in the scanning direction.

The platen 40 is located at a lower position with respect to the head 10. On an upper surface of the platen 40, the sheet 1 may be placed to be supported.

The conveyer 50 has two (2) roller pairs 51, 52. Between the roller pair 51 and the roller pair 52 in the conveying direction, the head 10 and the platen 40 are arranged. When, under the control of the controller 90, a conveyer motor 50*m* (see FIG. 3) is driven, the roller pairs 51, 52 may nip the sheet 1 between the respective rollers and rotate to convey the sheet 1 in the conveying direction. Thus, the conveyer 50 may convey the sheet 1 relatively to the head 10.

The flushing receiver member 60 is arranged between the guides 31, 32 in the conveying direction and has a flushing range 60*r* on a surface thereof. The flushing range 60*r* is located outside a conveyable range, within which the sheet 1 may be conveyed by the conveyer 50, and adjoins the conveyable range in the scanning direction. In a flushing process, which will be described below, the liquid may be discharged at the flushing range 60*r* to flush the nozzles N.

The cap 70 is a box-shaped member, which is open on an upper side thereof. The cap 70 may move in the vertical direction by driving a cap lift motor 70*m* (see FIG. 3). When the head 10 is located above the cap 70, the cap lift motor 70*m* may be driven under the control of the controller 90, and the cap 70 may move upward. Thereby, the cap 70 may contact the lower face of the head 10 at an upper rim thereof, and a sealed space is formed between the cap 70 and the head 10. When the cap 70 contacts the lower face of the head 10, the nozzles N formed in the head 10 are entirely covered with the cap 70. The state of the cap 70 covering the entire nozzles N may be herein called as a capping state. On the other hand, when the cap 70 is separated from the head 10, not covering the nozzles N, in other words, a state, in which the sealed space is not formed between the cap 70 and the head 10, may be herein called as an uncapping state.

The cap 70 is connected with a waste ink tank 77 through a tube (not shown) and a suction pump 70*p*. When the cap 70 is in the capping state, the suction pump 70*p* may be driven under the control of the controller 90, and the pressure in the sealed space between the cap 70 and the head 10 may be reduced, and the ink may be expelled from the nozzles N. The expelled ink may be received in the cap 70 and may flow to the waste ink tank 77.

The cartridge unit 80 includes four (4) cartridges 80*c*, 80*m*, 80*y*, 80*k*, which may store inks in different colors of cyan, magenta, yellow, and black, respectively. Each of the cartridges 80*c*, 80*m*, 80*y*, 80*k* is connected through a tube to a common flow path 12*a* (see FIG. 2) in the head 10.

Figure 2:
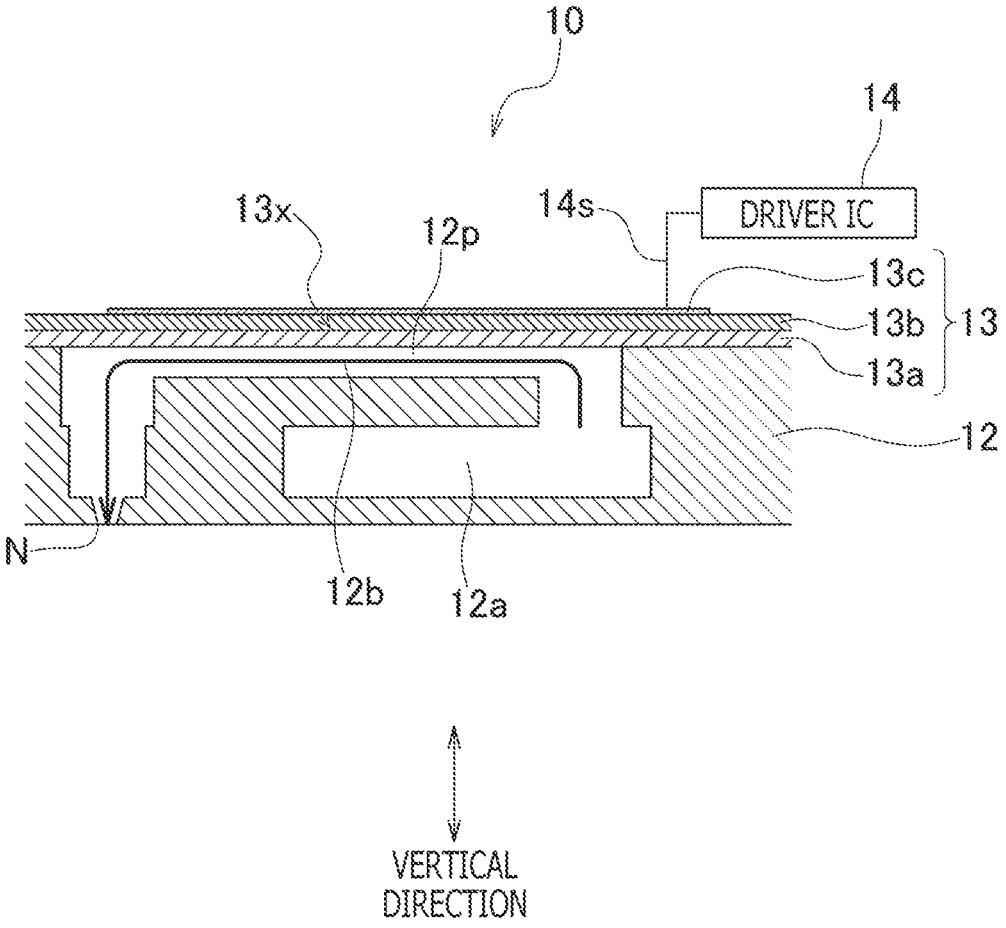
FIG. 2 is a cross-sectional view of a head in the printer according to the first embodiment of the present disclosure.

The head 10 includes a flow path unit 12 and an actuator unit 13, as shown in FIG. 2.

On a lower face of the flow path unit 12, the plurality of nozzles N (see FIG. 1) are formed. Inside the flow path unit 12, the common flow path 12*a* connected to the cartridge unit 80 (see FIG. 1) and individual flow paths 12*b*, each of which is connected to one of the nozzles N, are formed. The individual flow paths 12*b* are flow paths, each of which is continuous from an exit of the common flow path 12*a* through one of pressure chambers 12*p* to one of the nozzles N. The flow path unit 12 has the plurality of pressure chambers 12*p*, which are open to an upper side thereof.

The actuator unit 13 includes a metal-made vibration board 13*a*, a piezoelectric layer 13*b*, and a plurality of individual electrodes 13*c*. The vibration board 13*a* is arranged on the upper side of the flow path unit 12 to cover the plurality of pressure chambers 12*p*. The piezoelectric layer 13*b* is arranged on an upper side of the vibration board 13*a*. The plurality of individual electrodes 13*c* are arranged on an upper side of the piezoelectric layer 13*b*. Each of the individual electrodes faces toward one of the plurality of pressure chambers 12*p*.

The vibration board 13*a* and the plurality of individual electrodes 13*c* are connected electrically with a driver IC 14. The driver IC 14 maintains potential of the vibration board 13*a* at the ground potential and changes potentials of the individual electrodes 13*c* between the ground potential and a driving potential. In particular, the driver IC 14 may generate driving signals based on controlling signals, e.g., waveform signal FIRE and selection signal SIN, from the controller 90 and supply the driving signals to the individual electrodes 13*c* through signal lines 14*s*. Thereby, the potentials of the individual electrodes 13*c* may change between the driving potential and the ground potential. Accordingly, an actuator 13*x*, which is a part of the vibration board 13*a* and the piezoelectric layer 13*b*, interposed between the individual electrode 13*c* and the pressure chamber 12*p* may deform, and a volume of the pressure chamber 12*p* may change. When the volume of the pressure chamber 12*p* increases, the ink may be drawn from the common flow path 12*a* to the individual flow path 12*b*, and the ink may be supplied from the cartridge 80*c*, 80*m*, 80*y*, or 80*k* to the common flow path 12*a*. When the volume of the pressure chamber 12*p* is reduced, pressure may be applied to the ink in the pressure chamber 12*p*, and the ink may be discharged through the nozzle N. The actuator 13*x* is provided to each of the individual electrodes 13*c*, in other words, to each of the nozzles N, and may deform independently according to the potential supplied to the respective individual electrode 13*c*.

Figure 3:
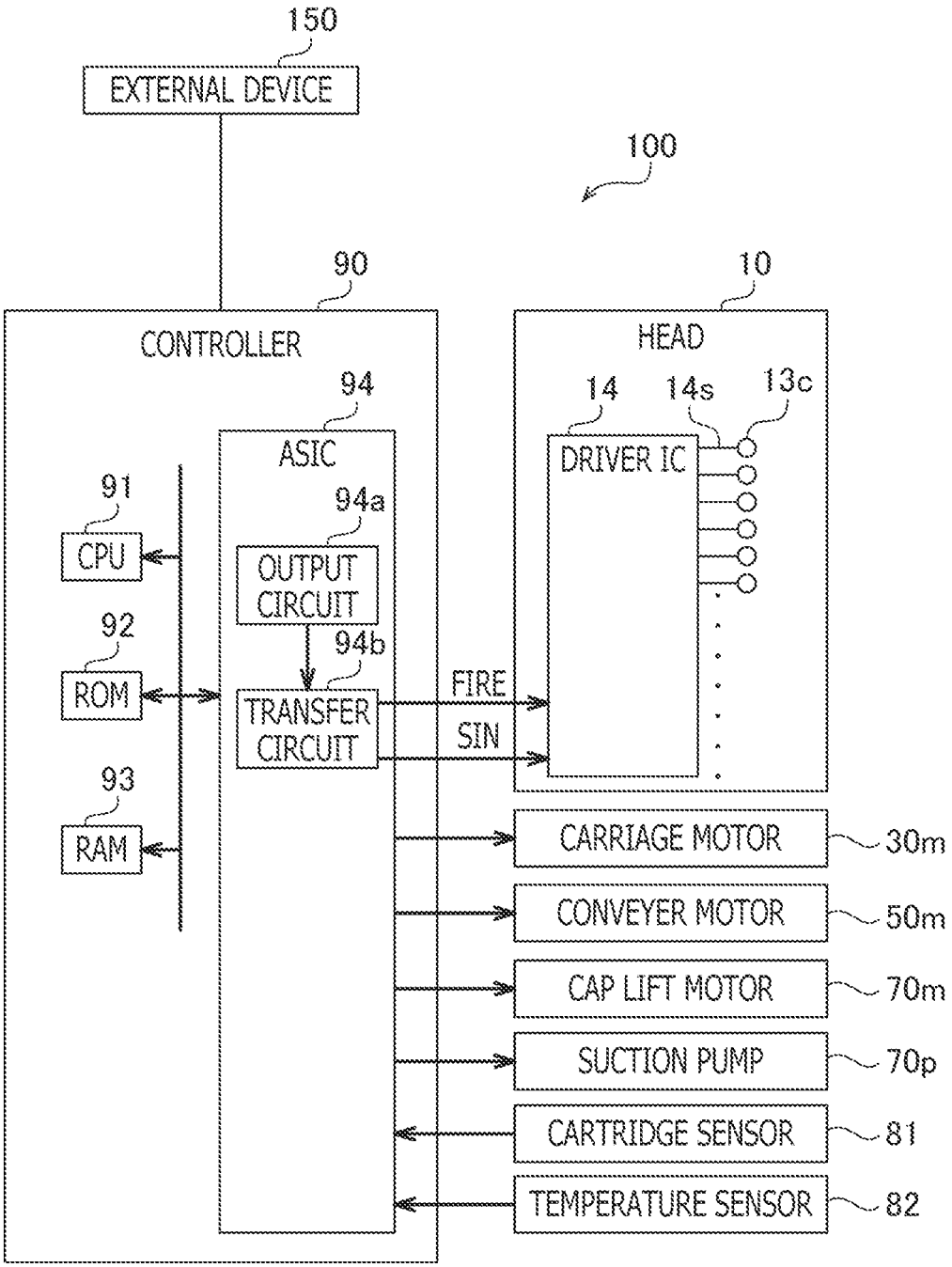
FIG. 3 is a block diagram to illustrate electrical components in the printer according to the first embodiment of the present disclosure.

The controller 90 includes, as shown in FIG. 3, a central processing unit (CPU) 91, a read only memory (ROM) 92, a random access memory (RAM) 93, and an application specific integrated circuit (ASIC) 94.

The ROM 92 stores programs and data to be used by the CPU 91 and/or the ASIC 94 to control operations in the printer 100. The RAM 93 may temporarily store data, such as image data, to be used by the CPU 91 and/or the ASIC 94 to execute the programs. The controller 90 is connected to communicate with an external device 150, such as a personal computer, and the CPU 91 and ASIC 94 may conduct processes, such as a recording process, based on the data input from the external device 150 and/or an input device, e.g., switches and buttons arranged on an exterior of a housing of the printer 100.

In the recording process, the ASIC 94 may control the driver IC 14, the carriage motor 30*m*, and the conveyer motor 50*m* according to commands from the CPU 91 and based on a record command, which includes image data, received from, for example, the external device 150. In particular, a conveying action, in which the conveyer 50 conveys the sheet 1 in the conveying direction by a predetermined distance, a moving action, in which the scanning assembly 30 moves the head 10 in the scanning direction, and a discharging action, in which the head 10 discharges the ink through the nozzles N to form dots on the sheet 1 while being moved in the moving action, may be conducted. Thus, an image in dots may be recorded on the sheet 1.

The ASIC 94 includes, as shown in FIG. 3, an output circuit 94*a* and a transfer circuit 94*b*.

The output circuit 94*a* may generate the waveform signal FIRE and the selection signal SIN and output the generated signals to the transfer circuit 94*b* at each recording cycle. The recording cycle is a time period required for the sheet 1 to move with respect to the head 10 by a unit distance corresponding to a resolution of the image to be formed on the sheet 1, which corresponds to one pixel.

The waveform signal FIRE is a serial signal, in which four units of waveform data are serially combined. Each unit of waveform data indicates a size of a droplet of the ink, which is one of "zero (no discharging)," "small," "medium," and "large" having different numbers of pulses, to be discharged from the nozzle N in the single recording cycle.

The selection signal SIN is a serial signal containing selection data for selecting one of the four units of waveform data. The selection signal SIN is generated for each of the actuators 13*x* and for each recording cycle based on the image data contained in the record command.

The transfer circuit 94*b* may transfer the waveform signal FIRE and the selection signal SIN received from the output circuit 94*a* to the driver IC 14. The transfer circuit 94*b* incorporates an LVDS (low voltage differential signaling) driver corresponding to the waveform signal FIRE and the selection signal SIN and may transfer the waveform signal FIRE and the selection signal SIN to the driver IC 14 as pulse-formed differential signals.

The ASIC 94 may, in the recording process, control the driver IC 14 to generate driving signals based on the waveform signal FIRE and the selection signal SIN for each pixel and supply the generated driving signals to the individual electrodes 13*c* through the signal lines 14*s*. Thereby, the ASIC 94 may cause the ink to be discharged from each of nozzles N in the size selected among the four droplet sizes, which are zero, small, medium, and large, at the sheet P.

The ASIC 94 is electrically connected to a cartridge sensor 81 and a temperature sensor 82, additionally to the driver IC 14, the carriage motor 30*m*, the conveyer motor 50*m*, the cap lift motor 70*m*, and the suction pump 70*p*. The cartridge sensor 81 is located in an attachment section 80A (see FIG. 1). The cartridge sensor 81 may detect data in IC chips provided to the cartridge unit 80 and output the detected data to the SIC 91. The temperature sensor 82 may detect a temperature in the head 10 and output data indicating the detected temperature to the ASIC 94.

Next, with reference to FIGS. 4A-4B, 5, and 6, the program to be executed by the CPU 91 will be described.

When the program starts, the head 10 is located above the cap 70 (see FIG. 1), and the cap 70 is in the capping state. In this arrangement, the nozzles N formed in the head 10 are entirely covered with the cap 70.

Figure 4A:
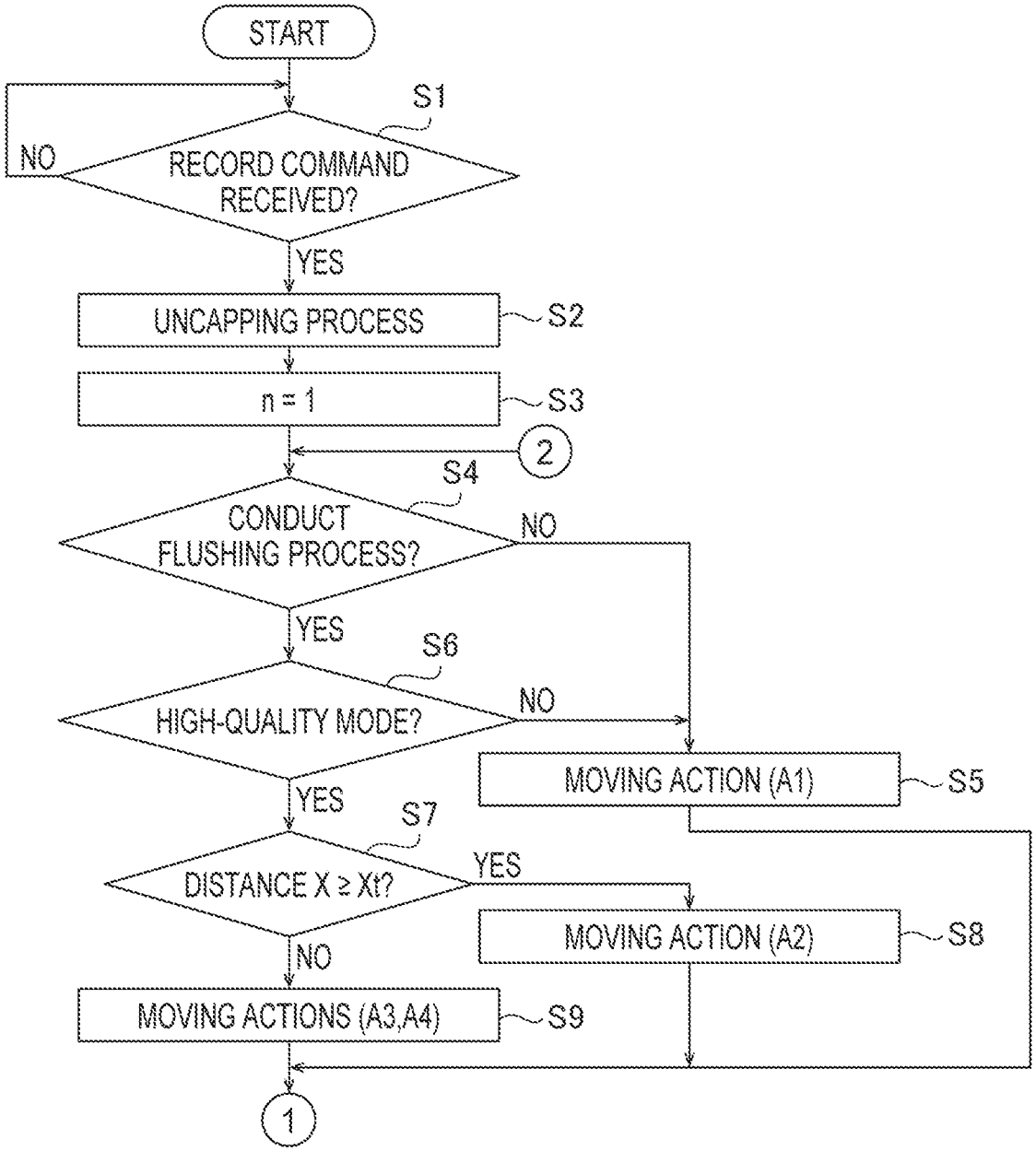
FIGS. 4A-4B are a flowchart to illustrate a flow of steps in a program to be executed by a CPU in the printer according to the first embodiment of the present disclosure.
Figure 4B:
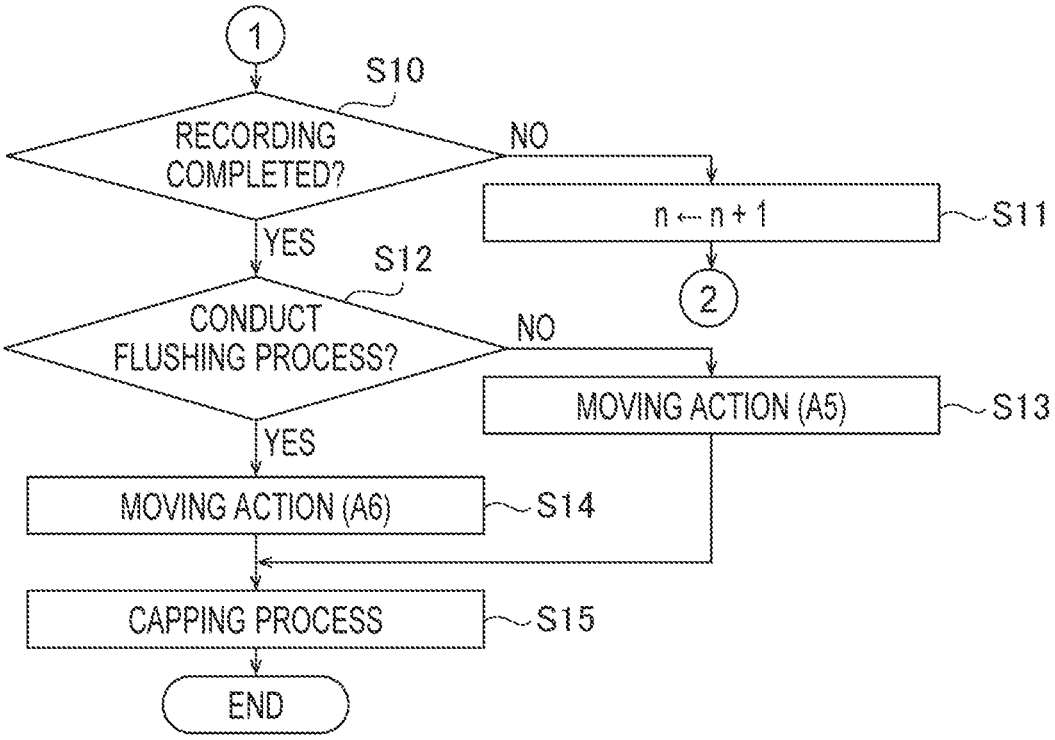

First, in S1, as shown in FIG. 4A, the CPU 91 determines whether the record command is received from, for example, the external device 150. If the record command is not received (S1: NO), the CPU 91 repeats S1.

If the record command is received (S1: YES), in S2, the CPU 91 drives the cap lift motor 70*m* to move the cap 70 downward, and the cap 70 is shifted from the capping state to the uncapping state (S2: uncapping process).

After S2, in S3, the CPU 91 assigns 1 to n (n=1). The sign n represents a number assigned to each one of moving actions, which accompanies a discharging action for forming dots, numbered in a chronological order.

After S3, in S4, the CPU 91 determines whether the flushing process is conducted in the n-th moving action. The flushing process is a process, in which the inks are discharged through the nozzles N at the flushing range 60*r*, without forming dots on the sheet 1, based on flushing data different from the image data. The flushing process may be conducted when the head 10 being moved in the moving action is accelerating.

Figure 5:
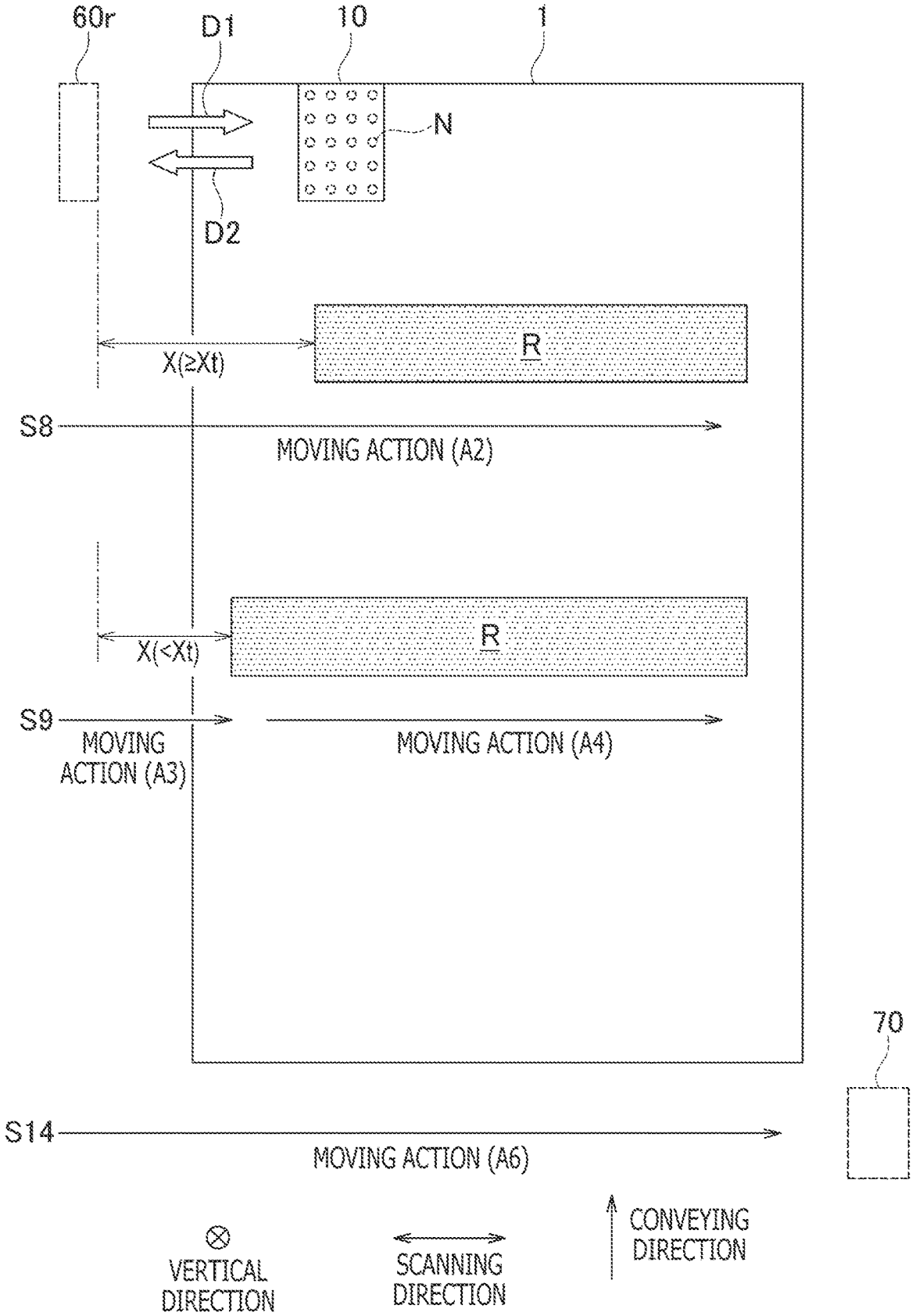
FIG. 5 is a schematic diagram to illustrate S8, S9, and S14 in the flowchart shown in FIGS. 4A-4B according to the embodiment of the present disclosure.

The flushing range 60*r* is located on one side in the scanning direction, e.g., a left side in FIG. 5, of a discharging range R, in which inks may be discharged through the nozzles N in the n-th moving action.

The moving action includes a forward moving action, in which the head 10 is moved in one way from the one side toward the other side, e.g., rightward D1 in FIG. 5, along the scanning direction, and a backward moving action, in which the head 10 is moved in the other way from the other side toward the one side, e.g., leftward D2 in FIG. 5, along the scanning direction. In the forward moving action, the head 10 may start moving from a starting position, which overlaps the flushing range 60*r* in the vertical direction, and end moving at an ending position, which overlaps the cap 70 in the vertical direction. In the backward moving action, the head 10 may start moving from a starting position, which overlaps the cap 70 in the vertical direction, and end moving at an ending position, which overlaps the flushing range 60*r* in the vertical direction.

In the present embodiment, when the n-th moving action is a forward moving action and when a predetermined condition, such as time elapsed from a previous flushing process, is satisfied, the CPU 91 may determine in S4 to conduct the flushing process (S4: YES).

The flushing process may be conducted while the head 10 is moving in the direction D1 without stopping the head 10. In particular, the CPU 91 may, while the head 10 is moving in the direction D1, drive the driver IC 14 based on the flushing data to deform the actuators 13*x* at the timing when each of the nozzle arrays Nc, Nm, Ny, Nk overlaps the flushing range 60*r* in the vertical direction to discharge the ink through the nozzles N that belong to the respective one of the nozzle arrays Nc, Nm, Ny, Nk. The discharged ink may be received in the flushing range 60*r* and flow to the waste ink tank 77 (see FIG. 1).

If the CPU 91 determines that the flushing process is not to be conducted (S4: NO), in S5, the CPU 91 conducts the n-th moving action at a first acceleration rate A1. While the n-th moving action is being conducted, the CPU 91 may conduct the discharging action to form dots when a velocity of the head 10 is at an aimed velocity Vt.

Figure 6:
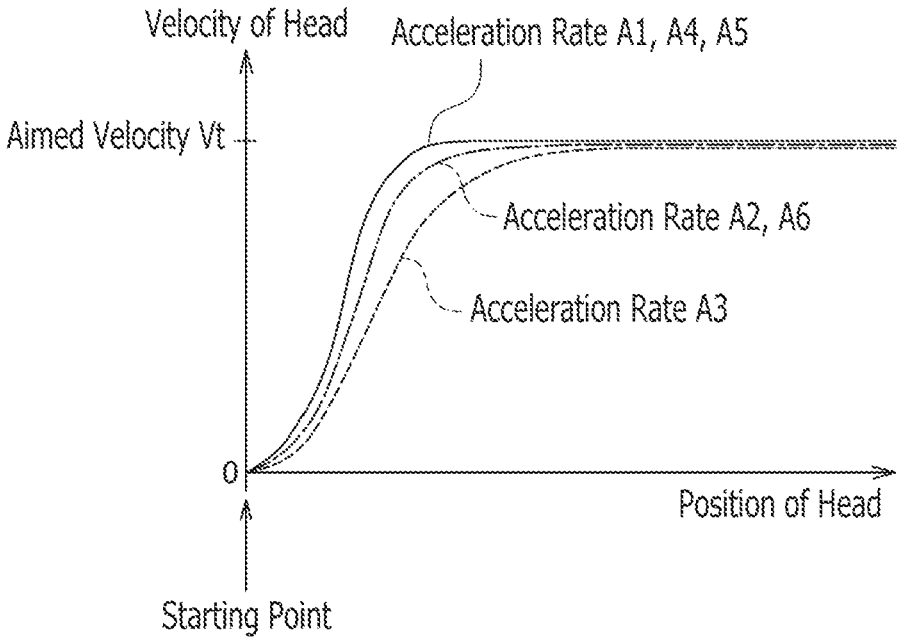
FIG. 6 is a graph to illustrate relationship between velocity and position of the head in the printer according to the embodiment of the present disclosure.

As shown in FIG. 6, in each moving action, the velocity of the head 10 increases from zero (0) to the aimed velocity Vt while the head 10 moves in either the direction D1 or the direction D2 from the starting position. The velocity of the head 10 is maintained at the aimed velocity Vt for a predetermined length of time, and thereafter, decreases from the aimed velocity Vt to zero. A length of time for the moving velocity of the head 10 to reach the aimed velocity Vt from zero varies depending on a level of the acceleration rate: the higher the acceleration rate is, the shorter the time length is.

When the flushing process is determined to be conducted (S4: YES), in S6, the CPU 91 determines whether a recording mode indicated in the record command received in S1 is a high-quality mode. In the present embodiment, the recording mode includes the high-quality mode (first mode) and a regular-quality mode (second mode). Between the high-quality mode and the regular-quality mode, the aimed velocity Vt (see FIG. 6) is different. The aimed velocity Vt in the regular-quality mode (second velocity) is faster than the aimed velocity Vt in the high-quality mode (first velocity).

If the recording mode is not the high-quality mode (S6: NO), in other words, if the recording mode is the regular-quality mode, in S5, the CPU 91 conducts the n-th moving action to move the head 10 at the first acceleration rate A1. While the n-th moving action is being conducted, in particular, while the velocity of the head 10 is at the aimed velocity Vt, the CPU 91 may conduct the discharging action to form dots on the sheet 1.

If the recording mode is the high-quality mode (S6: YES), in S7, the CPU 91 determines whether a distance X in the scanning direction between the flushing range 60*r* and the discharging range R, as shown in FIG. 5, is greater than or equal to a predetermined distance Xt.

If the distance X is greater than or equal to the predetermined distance Xt (S7: YES), in S8, the CPU 91 conducts the n-th moving action to move the head 10 at a second acceleration rate A2, as shown in FIG. 6. The second acceleration rate A2 is lower than the first acceleration rate A1 in S5. While the moving action is being, until the velocity of the head 10 increasing from zero reaches the aimed velocity Vt, in other words, while the head 10 is accelerating, the CPU 91 may conduct the flushing process, and once the velocity of the head 10 reaches the aimed velocity Vt, the CPU 91 may conduct the discharging action to form dots on the sheet 1 while the aimed velocity Vt is maintained.

If the distance X is neither greater than nor equal to the predetermined distance Xt (S7: NO), in other words, if the distance X is smaller than the predetermined distance Xt, the CPU 91 conducts a first step, in which the CPU 91 conducts the moving action to move the head 10 at a third acceleration rate A3 and the flushing process, and thereafter, without stopping the head 10, a second step, in which the CPU 91 conducts the moving action at a fourth acceleration rate A4 in the same direction as the first step, as shown in FIG. 6. The third acceleration rate A3 is lower than the first acceleration rate A1 in S5. The fourth acceleration rate A4 is higher than the third acceleration rate A3. The CPU 91 may conduct, in the first step, the flushing process and, in the second step, the discharging action to form dots on the sheet 1 while the velocity of the head 10 is at the aimed velocity Vt in S9. In the second step, the CPU 91 does not conduct the flushing process.

In the present embodiment, the fourth acceleration rate A4 is equal to the first acceleration rate A1 and is higher than the second acceleration rate A2. The third acceleration rate A3 is lower than the second acceleration rate A2 (see FIG. 6).

After S5, S8, or S9, in S10 (see FIG. 4B), the CPU 91 determines whether the recording process based on the record command received in S1 is completed. The CPU 91 may determine the recording process is completed (S10: YES) when the number n is equal to M (n=M). The sign M represents a number of the moving actions, which accompany the discharging action for forming dots. The number M is determined based on the image data in the record command.

If the recording process is not completed (S10: NO), in S11, the CPU 91 increments n by one (n=n+1). The CPU 91 returns to S4.

If the recording process is completed (S10: YES), in S12, the CPU 91 determines whether the flushing process is to be conducted in the next moving action, i.e., a forward moving action which does not accompany a discharging action for forming dots. If, by the time of S12, the head 10 is not located at the starting position of the forward moving action, i.e., not located at the position overlapping the flushing range 60*r* in the vertical direction, the CPU 91 may move the head 10 to the starting position prior to S13, S14, which will be described below.

If the CPU 91 determines not to conduct the flushing process in the forward moving action (S12: NO), in S13, the CPU 91 conducts the forward moving action to move the head 10 at a fifth acceleration rate A5.

If the CPU 91 determines to conduct the flushing process (S12: YES), in S14, the CPU 91 conducts the forward moving action to move the head 10 at a sixth acceleration rate A6. The sixth acceleration rate A6 is lower than the fifth acceleration rate A5 in S13.

After S13 or S14, in S15, when the head 10 is located at the ending position of the forward moving action, i.e., the position overlapping the cap 70 in the vertical direction, the CPU 91 drives the cap lift motor 70*m* to move the cap 70 upward and shift the cap 70 from the uncapping state to the capping state (S15: capping process).

After S15, the CPU 91 terminates the program.

As described above, according to the present embodiment, when the flushing process is determined to be conducted in the n-th moving action (S4: YES), the CPU 91 determines whether the distance X between the flushing range 60*r* and the discharging range R in the scanning direction is greater than or equal to the predetermined distance Xt (S7). If the distance X is greater than or equal to the predetermined distance Xt (S7: YES), the CPU 91 conducts the n-th moving action (S8) to move the head 10 at the second acceleration rate A2, which is lower than the first acceleration rate A1 in S5. In this arrangement, while the head 10 is accelerating, the flushing process may be conducted at the second acceleration rate A2, which is relatively low, so that the negative pressure in the head 10 may be restrained from increasing, and a sufficient amount of the ink may be discharged.

Moreover, when the flushing process is conducted, the distance X is greater than equal to the predetermined distance Xt; therefore, after the flushing process, the velocity of the head 10 may reach the aimed velocity Vt before starting the discharging action to form dots on the sheet 1. Accordingly, the discharging action may be conducted stably, and the imaging quality may be secured.

When the distance X is neither greater than nor equal to the predetermined distance Xt (S7: NO), the CPU 91 may conduct the first step, in which the moving action to move the head 10 at the third acceleration rate A3 being lower than the first acceleration rate A1 and the flushing process are conducted, and thereafter the second step, in which the moving action to move the head 10 at the fourth acceleration rate A4 being higher than the third acceleration rate A3 in the same direction as the first step (S9). In this arrangement, when the distance X is short, the flushing process may be conducted at the third acceleration rate A3, which is relatively low; thereby, the negative pressure in the head 10 may be restrained from increasing, and the inks sufficient for flushing may be discharged. Further, after the flushing process, the acceleration rate may be shifted to the fourth acceleration rate A4, which is relatively high, so that the velocity of the head 10 may reach the aimed velocity Vt rapidly. Accordingly, the discharging actions to form dots on the sheet 1 may be conducted stably, and the imaging quality may be secured.

In the forward moving action which does not accompany a discharging action for forming dots, the CPU 91 may determine whether the flushing process is to be conducted (S12). If the flushing process is not to be conducted in the forward moving action (S12: NO), the CPU 91 may conduct the forward moving action to move the head 10 at the fifth acceleration rate A5 (S13). If the flushing process is determined to be conducted in the forward moving action (S12: YES), the CPU 91 may conduct the forward moving action to move the head 10 at the sixth acceleration rate A6 being lower than the fifth acceleration rate A5 and the flushing process. In this arrangement, in the forward moving action, in which the discharging action for forming dots on the sheet 1 is not conducted, the flushing process may be conducted at the sixth acceleration rate, which is relatively low, so that the negative pressure in the head 10 may be restrained from increasing, and the ink in the sufficient amount for flushing may be discharged.

When the recording mode is the high-quality mode (S6: YES), the CPU 91 may conduct S7. On the other hand, when the recording mode is not the high-quality mode (S6: NO), in other words, the recording mode is the regular-quality mode, the CPU 91 may not conduct S7. In this arrangement, in the regular-printing mode, in which the recording speed may be more emphasized than the imaging quality, S7 is not conducted; therefore, without conducting the flushing process at the second acceleration rate A2 which is relatively low, images may be recorded faster in shorter time.

Second Embodiment

Figure 7A:
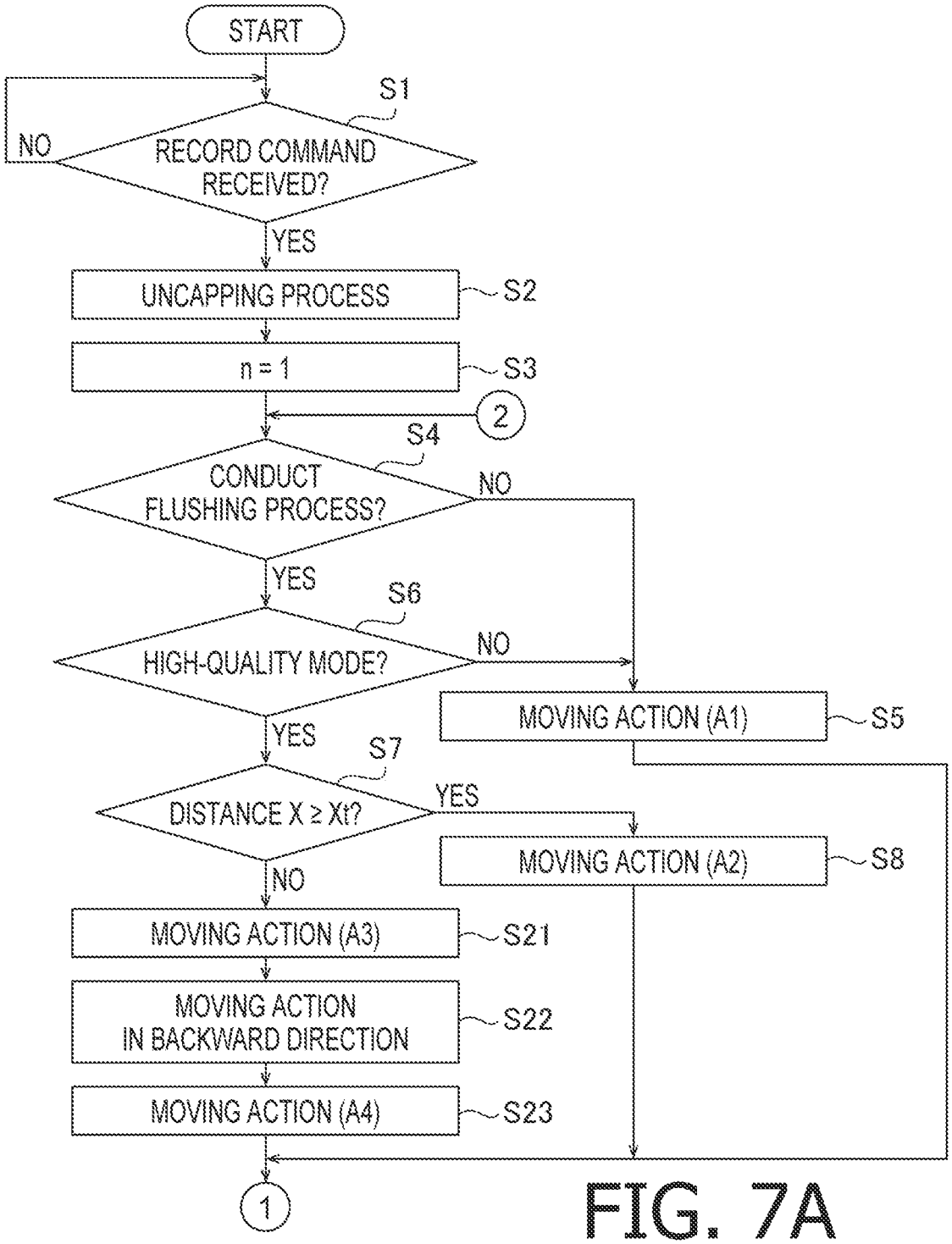
FIGS. 7A-7B are a flowchart to illustrate a flow of steps in a program to be executed by the CPU in the printer according to a second embodiment of the present disclosure.
Figure 7B:
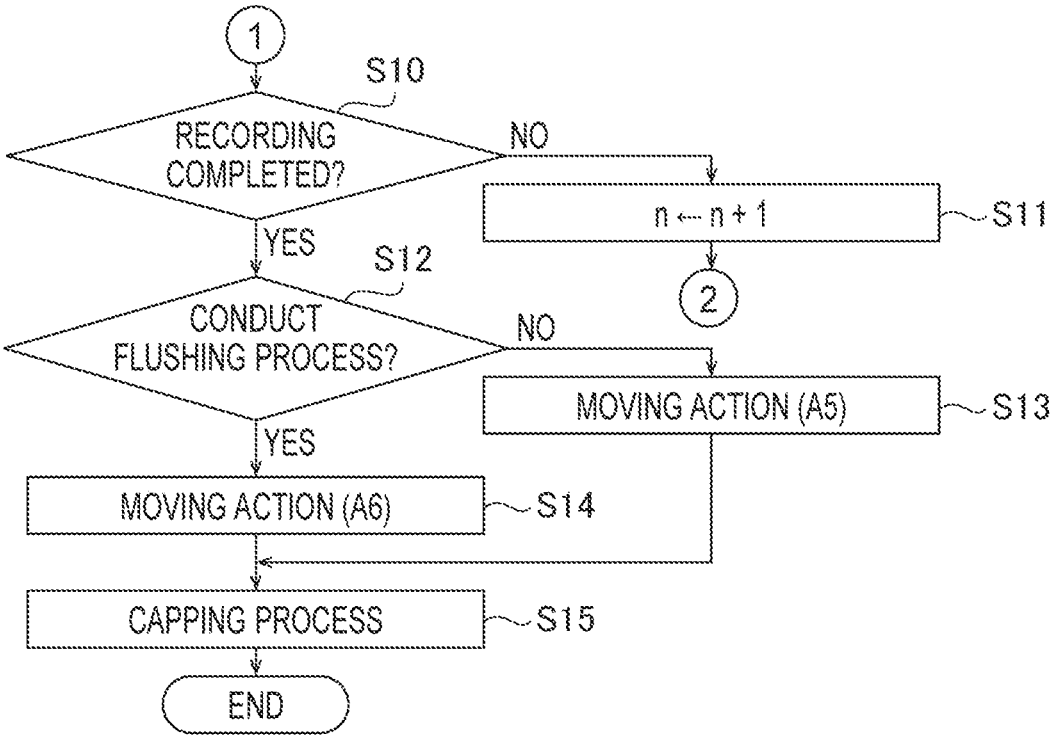

Next, with reference to FIGS. 7 and 8, the printer according to a second embodiment of the present disclosure will be described.

In the first embodiment described above, when the distance X is neither greater than nor equal to the predetermined distance Xt (S7: NO), the CPU 91 may conduct the first step, in which the moving action to move the head 10 at the third acceleration rate A3 being lower than the first acceleration rate A1 and the flushing process are conducted, and thereafter the second step, in which the moving action to move the head 10 at the fourth acceleration rate A4 being higher than the third acceleration rate A3 in the same direction as the first step (S9).

In S9 in the first embodiment, as shown in FIG. 5, the head 10 is moved in the single direction D1 continuously.

Meanwhile, in the second embodiment, when the distance X is neither greater than nor equal to the predetermined distance Xt (S7: NO), the CPU 91 may conduct a first step (S21), in which the moving action to move the head 10 at the third acceleration rate A3 being lower than the first acceleration rate A1 and the flushing process are conducted, thereafter a second step (S22), in which the moving action to move the head 10 in the opposite direction, i.e., the direction D2, opposite to the moving direction in the first step is conducted, and a third step (S23), in which the moving action to move the head 19 at the fourth acceleration rate A4 being higher than the third acceleration rate A3 in the same direction as the moving direction in the first step, i.e., the direction D1, and the discharging action to form dots on the sheets 1 are conducted.

Figure 8:
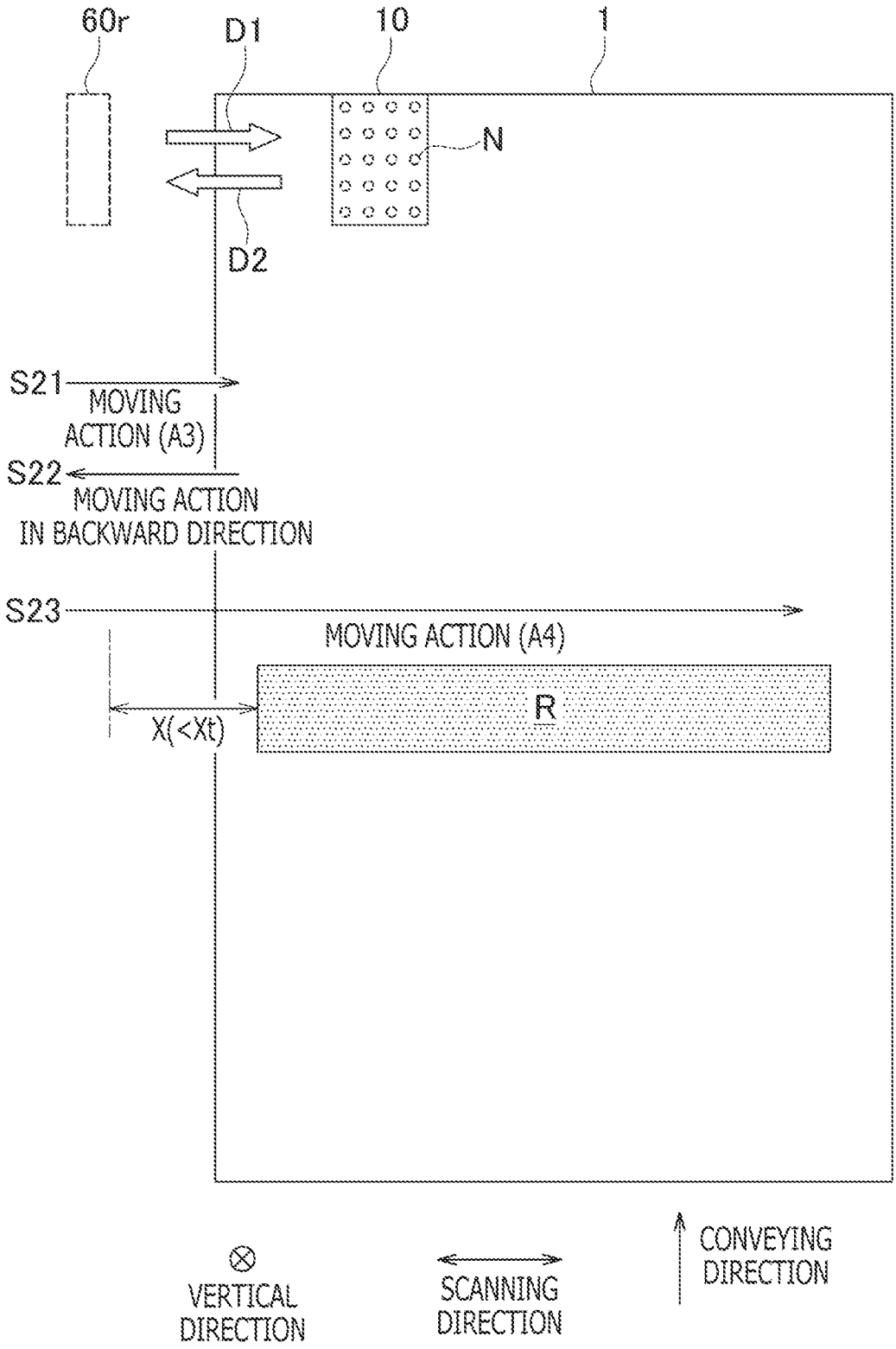
FIG. 8 is a schematic diagram to illustrate S21-S23 in the flowchart shown in FIG. 7A according to the second embodiment of the present disclosure.

In S21-S23 in the second embodiment, as shown in FIG. 8, the head 10 may be moved in the direction D1 in the first step, thereafter, in the direction D2 in the second step, and thereafter, in the direction D1 in the third step. The CPU 91 may conduct the flushing process in the first step and the discharging action in the third step when the velocity of the head 10 is at the aimed velocity Vt. The CPU 91 does not conduct the flushing process in the second step or the third step.

The starting position of the head 10 in the first step, the ending position of the head 10 in the second step, and the starting portion of the head 10 in the third step overlap the flushing range 60*r* in the vertical direction. The ending position of the head 10 in the first step and the starting position of the head 10 in the second step vertically overlap an area in proximity to an end of the discharging range R of the n-th moving action in the scanning direction, e.g., leftward end of the discharging range R in FIG. 8.

According to the second embodiment, additionally to the benefits achievable by the first embodiment, benefit as described below may be achieved.

That is, even when the distance X is short, the flushing process may be conducted at the third acceleration rate A3, which is relatively low; thereby, the negative pressure in the head 10 may be restrained from increasing, and the inks in the sufficient amounts for flushing may be discharged. Further, after the flushing process, the head 10 may be moved to return to the starting position of the forward moving action, which is the position vertically overlaps the flushing range 60*r*, and thereafter, the head 10 may be moved to the head 10 at the fourth acceleration rate A4, which is relatively higher. Thus, the velocity of the head 10 may reach the aimed velocity Vt rapidly. Accordingly, the discharging actions may be conducted stably, and the imaging quality may be secured.

Third Embodiment

Figure 9A:
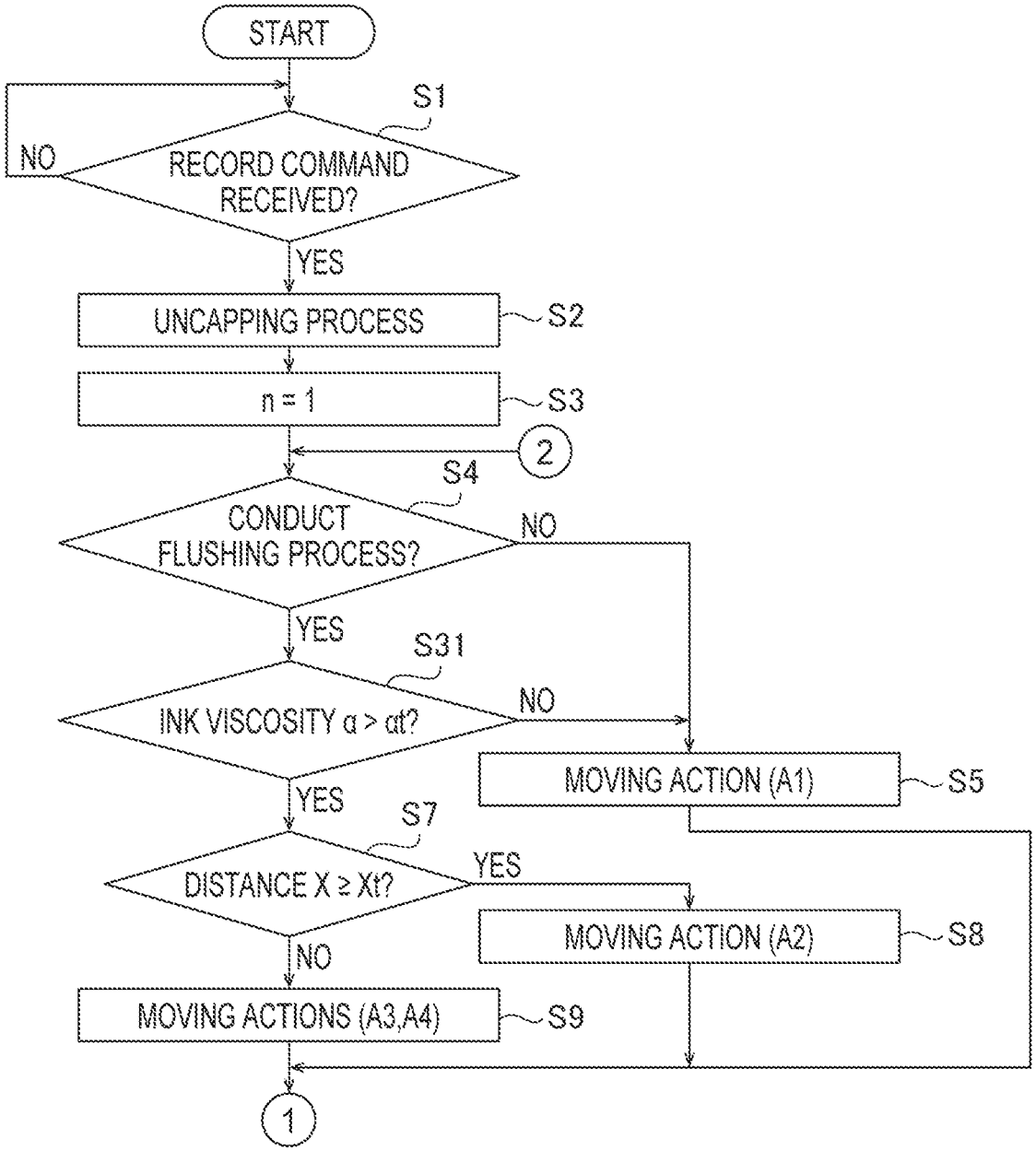
FIGS. 9A-9B are a flowchart to illustrate a flow of steps in a program to be executed by the CPU in the printer according to a third embodiment of the present disclosure.
Figure 9B:
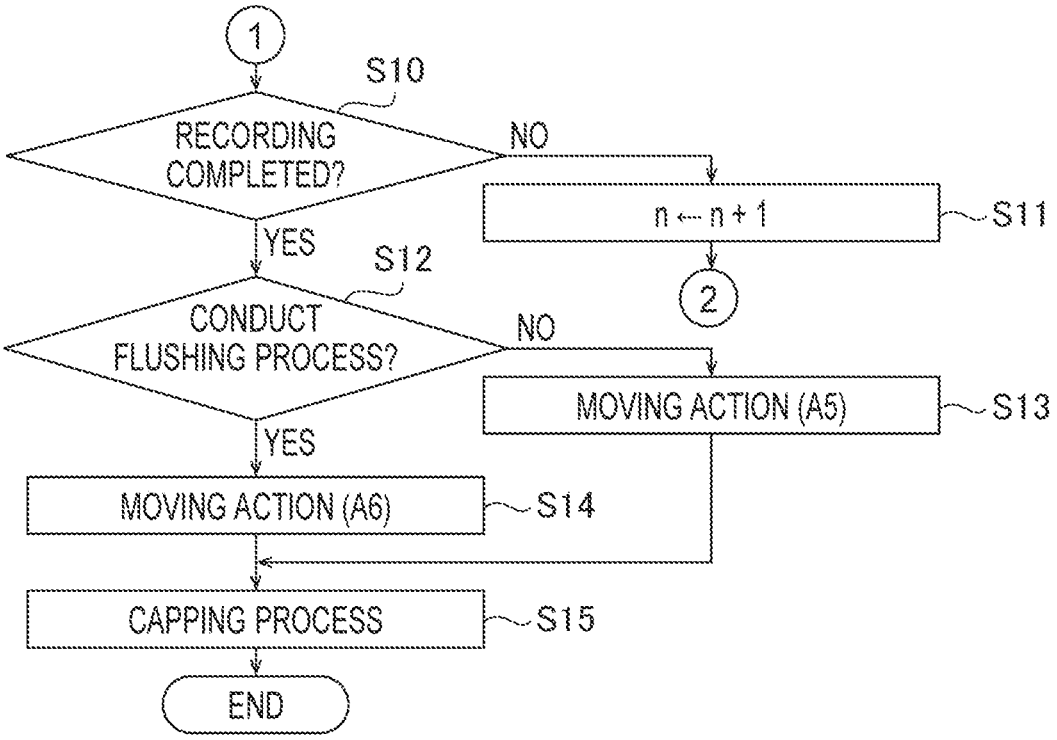

Next, with reference to FIGS. 9A-9B, the printer according to a third embodiment of the present disclosure will be described.

In the first embodiment described above, when the flushing process is determined to be conducted (S4: YES), the CPU 91 determines whether the recording mode is the high-quality mode (S6). If the recording mode is the high-quality mode (S6: YES), the CPU 91 may conduct S7, or if the recording mode is not the high-quality mode (S6: NO), in other words, if the recording mode is the regular-quality mode, the CPU 91 may not conduct S7.

In this regard, in the third embodiment, when the flushing process is determined to be conducted (S4: YES), the CPU 91 may determine whether a viscosity $\alpha$ of the ink is higher than a predetermined viscosity $\alpha t$. If the viscosity $\alpha$ is higher than the predetermined viscosity $\alpha t$ (S31: YES), the CPU 91 may conduct S7. On the other hand, if the viscosity $\alpha$ is not higher than the predetermined viscosity $\alpha t$ (S31: NO), in other words, if the viscosity $\alpha$ is lower than the predetermined viscosity $\alpha t$ (S31: NO), the CPU 91 may not conduct S7.

The CPU 91 may determine the viscosity $\alpha$ in S31 based on the signal from the cartridge sensor 81 (see FIG. 3). In particular, when the signal from the cartridge sensor 81 is a predetermined signal, the CPU 91 may determine that the cartridge unit 80 attached to the attachment section 80A is a predetermined type of tank and that the viscosity $\alpha$ is not higher than the predetermined viscosity $\alpha t$ (S31: NO). On the other hand, when the signal from the cartridge sensor 81 is not the predetermined signal, the CPU 91 may determine that the cartridge unit 80 attached to the attachment section 80A is not the predetermined type of tank and that the viscosity $\alpha$ is higher than the predetermined viscosity $\alpha t$ (S31: YES).

According to the third embodiment, additionally to the benefits achievable by the first embodiment, benefits as described below may be achieved.

That is, when the viscosity $\alpha$ is higher (S31: YES), the CPU 91 may conduct S7, or when the viscosity $\alpha$ is not higher (S31: NO), the CPU 91 may not conduct S7. When the viscosity $\alpha$ is lower, it may be less likely that the amount of discharged ink is insufficient for flushing. Therefore, even if the flushing process is conducted while the head 10 is accelerated, a sufficient amount of ink for flushing may be discharged. In this regard, according to the third embodiment, in the case where the viscosity $\alpha$ is lower, in which the discharging amount is less likely to be insufficient, the CPU 91 may not conduct S7. Thus, by avoiding the flushing process at the second acceleration rate A2, which is relatively low, images may be recorded faster in shorter time.

The CPU 91 may determine that the viscosity α is higher than the predetermined viscosity αt when the cartridge unit 80 is not the predetermined type of tank; or when the cartridge unit 80 is the predetermined type of tank, the CPU 91 may determine that the viscosity α is not higher than the predetermined viscosity αt. This determination is based on an aspect that, when the cartridge unit 80 is not the predetermined type of tank, components of the ink in the cartridge unit 80 may be different from the components of the ink in the predetermined tank; therefore, moisture in the ink may evaporate more easily, and the viscosity α may tend to increase. In this regard, the determination in S31 may be made easily and effectively.

Modified Examples

Although examples of carrying out the invention have been described, those skilled in the art will appreciate that there are numerous variations and permutations of the liquid discharging apparatus, the method for controlling the liquid discharging apparatus, and the computer-readable storage medium storing computer-readable instructions for discharging the liquid that fall within the spirit and the scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiments may merely be regarded as examples of the claimed subject matters.

For example, the options for the recording mode may not necessarily be limited to the high-quality mode and the regular-quality mode but may include, for example, a regular-paper mode and a glossy paper mode.

For another example, the third acceleration rate may not necessarily be limited, as long as the third acceleration rate is lower than the first acceleration rate. For example, the third acceleration rate may be equal to the second acceleration rate. Moreover, the fourth acceleration rate may not necessarily be limited, as long as the fourth acceleration rate is higher than the third acceleration rate. For example, the fourth acceleration rate may be equal to the second acceleration rate.

For another example, the fifth acceleration may not necessarily be limited but may be different from the first acceleration rate. Moreover, the sixth acceleration rate may not necessarily be limited, as long as the sixth acceleration rate is lower than the fifth acceleration rate. For example, the fifth acceleration rate may be equal to the second acceleration rate shown in FIG. 2, and the sixth acceleration rate may be equal to the third acceleration rate shown in FIG. 6.

For another example, the determination in S12 may not necessarily be based on completion of the moving action in the recording process but may be based on, for example, an ongoing moving action in the recording process.

For another example, the controller may not necessarily determine in S12 whether the flushing process is to be conducted.

For another example, the determination in S31 in the third embodiment described above may not necessarily be limited to the manner such that, if the signal from the cartridge sensor 81 is the predetermined signal, the CPU 91 determines that the cartridge unit 80 attached to the attachment section 80A is the predetermined type of tank; or if the signal from the cartridge sensor 81 is not the predetermined signal, the CPU 91 may determine that the cartridge unit 80 attached to the attachment section 80A is not the predetermined type of tank. Rather, for example, the CPU 91 may determine that the cartridge unit 80 attached to the attachment section 80A is the predetermined type of tank if the signal from the cartridge sensor 81 is not the predetermined signal, and thereby may determine that the viscosity α is not higher than the predetermined viscosity αt. For another example, the CPU 91 may determine that the cartridge unit 80 attached to the attachment section 80A is not the predetermined type of tank if the signal from the cartridge sensor 81 is the predetermined signal, and thereby may determine that the viscosity α is higher than the predetermined viscosity αt (S31: YES).

For another example, the determination in S31 may be made based on a signal from the temperature sensor 82 (see FIG. 3). For example, the CPU 91 may determine that the viscosity α is not higher than the predetermined viscosity αt if the signal from the temperature sensor 82 indicates a temperature higher than or equal to a predetermined degree of temperature (S31: NO); or if the signal from the temperature sensor 82 indicates a temperature lower than the predetermined degree of temperature, the CPU 91 may determine that the viscosity α is higher than the predetermined viscosity αt (S31: YES).

For another example, the determination in S31 may be made based on one or more of various factors including, for example, ambient humidity in the head 10, components contained in the liquid, elapsed time since a previous discharging action, elapsed time since a previous flushing process. For example, if the ambient humidity is higher than or equal to a predetermined humidity, the CPU 91 may determine that the viscosity α is not higher than the predetermined viscosity αt (S31: NO); or if the ambient humidity is lower than the predetermined humidity, the CPU 91 may determine that the viscosity α is higher than the predetermined viscosity αt (S31: YES). For another example, due to difference in the components included in the inks, there may be a case where the viscosity of the black ink is higher than the viscosities in the other color inks. In such a case, the CPU 91 may determine that the viscosity α is higher than the predetermined viscosity αt (S31: YES) when the discharging action in the n-th moving action is a discharging action with use of the black ink alone. For another example, the CPU 91 may determine that the viscosity α is higher than the predetermined viscosity αt (S31: YES) when the elapsed time since the previous discharging action or the elapsed time since the previous flushing process is longer than or equal to a predetermined length of time.

For another example, the head may not necessarily have the nozzles that may discharge different types of liquid, i.e., inks in different colors, but may have nozzles that may discharge a same type of liquid, e.g., ink in a same color.

For another example, the liquid to be discharged through the nozzles may not limited to the ink but may be liquid other than ink such as, for example, a processing solution that may coagulate or precipitate the components in the ink.

For another example, a material of the sheet may not necessarily be limited paper but may be, for example, fabric or resin.

For another example, the present disclosure may not necessarily be applicable to a printer as described above but may be applicable to a facsimile machine, a copier, and a multifunction peripheral machine. Moreover, the present disclosure may be applied to a liquid discharging apparatus usable in a purpose other than image recording, such as, for example, a liquid discharging apparatus to discharge conductive liquid to form conductive patterns on a substrate.

The programs related to the present disclosure may be distributed in a form of removable storage medium such as a flexible disk and/or an immobilized storage medium such as a hard disk, or through communication lines.

What is claimed is:

1. A liquid discharging apparatus, comprising:

a head having a plurality of nozzles;

a scanning assembly configured to move the head in a scanning direction;

a conveyer configured to covey a recording medium with respect to the head in a conveying direction, the conveying direction intersecting with the scanning direction; and a controller configured to:

for recording an image on the recording medium, conduct actions to control the head to discharge liquid through the plurality of nozzles at the recording medium based on image data, the actions including:

a conveying action, in which the controller controls the conveyer to convey the recording medium by a predetermined amount in the conveying direction;

a moving action, in which the controller controls the scanning assembly to move the head in the scanning direction; and a discharging action, in which the controller controls the head to discharge the liquid through the plurality of nozzles while the head is moved by the scanning assembly in the moving action, and for flushing the plurality of nozzles with the liquid, control the head to discharge the liquid through the plurality of nozzles at a flushing range based on flushing data, the flushing data being different from the image data, while the head being moved in the moving action is accelerating, wherein the controller is further configured to:

determine whether the plurality of nozzles are to be flushed in the moving action which accompanies the discharging action, in a case where the controller determines that the plurality of nozzles are not to be flushed in the moving action, conduct the moving action to move the head at a first acceleration rate, in a case where the controller determines that the plurality of nozzles are to be flushed in the moving action, determine whether a distance between the flushing range and a discharging range, in which the liquid is to be discharged through the plurality of nozzles in the discharging action, is greater than or equal to a predetermined distance, and in a case where the controller determines that the distance is greater than or equal to the predetermined distance, conduct the moving action to move the head at a second acceleration rate being lower than the first acceleration rate and control the head to discharge the liquid for flushing the plurality of nozzles.

2. The liquid discharging apparatus according to claim 1, wherein, in a case where the controller determines that the distance is not greater than or equal to the predetermined distance, the controller is configured to conduct:

a first step, in which the controller conducts the moving action to move the head in one way in the scanning direction at a third acceleration rate being lower than the first acceleration rate and control the head to discharge the liquid for flushing, and a second step, in which, after the first step, the controller conducts the moving action to move the head in the same way as the one way in the first step in the scanning direction at a fourth acceleration rate being higher than the third acceleration rate.

3. The liquid discharging apparatus according to claim 1, wherein, in a case where the controller determines that the distance is not greater than or equal to the predetermined distance, the controller is configured to conduct:

a first step, in which the controller conducts the moving action to move the head in one way in the scanning direction at a third acceleration rate being lower than the first acceleration rate and control the head to discharge the liquid for flushing, a second step, in which, after the first step, the controller conducts the moving action to move the head in the other way opposite to the one way in the first step in the scanning direction, and a third step, in which, after the second step, the controller conducts the moving action to move the head in the same way as the one way in the first step in the scanning direction at a fourth acceleration rate being higher than the third acceleration rate.

4. The liquid discharging apparatus according to claim 1, wherein the flushing range is located on a first side of the discharging range in the scanning direction, wherein the moving action includes a forward moving action, in which the head is moved from the first side toward a second side in the scanning direction, and a backward moving action, in which the head is moved from the second side toward the first side in the scanning direction, wherein the controller is configured to determine whether the plurality of nozzles are to be flushed in the forward moving action which does not accompany the discharging action, wherein, in a case where the controller determines that the plurality of nozzles are not to be flushed in the forward moving action, conduct the forward moving action to move the head at a third acceleration rate, and wherein, in a case where the controller determines that the plurality of nozzles are to be flushed in the forward moving action, conduct the forward moving action to move the head at a fourth acceleration rate being lower than the third acceleration rate and control the head to discharge the liquid for flushing the plurality of nozzles.

5. The liquid discharging apparatus according to claim 1, wherein the controller is configured to determine whether a recording mode for recording the image is a first mode, in which recording of the image is conducted at a first velocity, or a second mode, in which recording of the image is conducted at a second velocity, the second velocity being higher than the first velocity, wherein, in a case where the controller determines that the recording mode is the first mode, the controller is configured to determine whether the distance between the flushing range and the discharging range is greater than or equal to the predetermined distance, and wherein, in a case where the controller determines that the recording mode is the second mode, the controller is configured to conduct the moving action without causing the plurality of nozzles to be flushed and without determining whether the distance between the flushing range and the discharging range is greater than or equal to the predetermined distance.

6. The liquid discharging apparatus according to claim 1, wherein the controller is configured to determine whether a viscosity of the liquid to be discharged through the plurality of nozzles in the discharging action is higher than a predetermined viscosity, wherein, in a case where the controller determines that the viscosity is higher than the predetermined viscosity, the controller is configured to determine whether the distance between the flushing range and the discharging range is greater than or equal to the predetermined distance, and wherein, in a case where the controller determines that the viscosity is not higher than the predetermined viscosity, the controller is configured to conduct the moving action without causing the plurality of nozzles to be flushed and without determining whether the distance between the flushing range and the discharging range is greater than or equal to the predetermined distance.

7. The liquid discharging apparatus according to claim 6, further comprising an attachment section, to which a tank configured to store the liquid is attachable, the tank being connected to the head and configured to supply the liquid to be discharged through the plurality of nozzles to the head, wherein, for determining whether the viscosity of the liquid to be discharged through the plurality of nozzles in the discharging action is higher than the predetermined viscosity, the controller is configured to:

in a case where the tank is not a predetermined type of tank, determine that the viscosity is higher than the predetermined viscosity, and in a case where the tank is the predetermined type of tank, determine that the viscosity is not higher than the predetermined viscosity.

8. A method for controlling a liquid discharging apparatus, the liquid discharging apparatus comprising a head having a plurality of nozzles, a scanning assembly configured to move the head in a scanning direction, and a conveyer configured to covey a recording medium with respect to the head in a conveying direction, the conveying direction intersecting with the scanning direction, the method comprising:

for recording an image on the recording medium, conducting actions to control the head to discharge liquid through the plurality of nozzles at the recording medium based on image data, the actions including:

a conveying action, in which the conveyer is controlled to convey the recording medium by a predetermined amount in the conveying direction;

a moving action, in which the scanning assembly is controlled to move the head in the scanning direction; and a discharging action, in which the head is controlled to discharge the liquid through the plurality of nozzles while the head is moved by the scanning assembly in the moving action, and flushing the plurality of nozzles with the liquid by controlling the head to discharge the liquid through the plurality of nozzles at a flushing range based on flushing data, the flushing data being different from the image data, while the head being moved in the moving action is accelerating, wherein, for controlling the liquid discharging apparatus, the method further comprises:

determining whether the plurality of nozzles are to be flushed in the moving action which accompanies the discharging action, in a case where the plurality of nozzles are determined not to be flushed in the moving action, conducting the moving action to move the head at a first acceleration rate, in a case where the plurality of nozzles are determined to be flushed in the moving action, determining whether a distance between the flushing range and a discharging range, in which the liquid is to be discharged through the plurality of nozzles in the discharging action, is greater than or equal to a predetermined distance, and in a case where the distance is determined to be greater than or equal to the predetermined distance, conducting the moving action to move the head at a second acceleration rate being lower than the first acceleration rate and controlling the head to discharge the liquid for flushing the plurality of nozzles.

9. A non-transitory computer readable storage medium storing computer readable instructions that are executable by a computer configured to control a liquid discharging apparatus, the liquid discharging apparatus comprising a head having a plurality of nozzles, a scanning assembly configured to move the head in a scanning direction, and a conveyer configured to covey a recording medium with respect to the head in a conveying direction, the conveying direction intersecting with the scanning direction, the computer readable instructions, when executed by the computer, causing the computer to:

for recording an image on the recording medium, conduct actions to control the head to discharge liquid through the plurality of nozzles at the recording medium based on image data, the actions including:

a conveying action, in which the computer controls the conveyer to convey the recording medium by a predetermined amount in the conveying direction;

a moving action, in which the computer controls the scanning assembly to move the head in the scanning direction; and a discharging action, in which the computer controls the head to discharge the liquid through the plurality of nozzles while the head is moved by the scanning assembly in the moving action, and for flushing the plurality of nozzles with the liquid, control the head to discharge the liquid through the plurality of nozzles at a flushing range based on flushing data, the flushing data being different from the image data, while the head being moved in the moving action is accelerating, wherein the computer readable instructions, when executed by the computer, further cause the computer to:

determine whether the plurality of nozzles are to be flushed in the moving action which accompanies the discharging action, in a case where the computer determines that the plurality of nozzles are not to be flushed in the moving action, conduct the moving action to move the head at a first acceleration rate, in a case where the computer determines that the plurality of nozzles are to be flushed in the moving action, determine whether a distance between the flushing range and a discharging range, in which the liquid is to be discharged through the plurality of nozzles in the discharging action, is greater than or equal to a predetermined distance, and in a case where the computer determines that the distance is greater than or equal to the predetermined distance, conduct the moving action to move the head at a second acceleration rate being lower than the first acceleration rate and control the head to discharge the liquid for flushing the plurality of nozzles.

* * * * *